US012685359B2

(12) United States Patent
Storey et al.

(10) Patent No.: US 12,685,359 B2
(45) Date of Patent: Jul. 21, 2026

(54) CELLULAR ENERGY-ABSORBING STRUCTURE FASTENING DEVICE

(71) Applicant: GEORGE TFE SCP, Monaco (MC)

(72) Inventors: Piers Christian Storey, Monaco (MC); James Rogers, Cumbria (GB)

(73) Assignee: GEORGE TFE SCP, Monaco (MC)

( * ) Notice: Subject to any disclaimer, the term of this patent is extended or adjusted under 35 U.S.C. 154(b) by 88 days.

(21) Appl. No.: 18/264,179

(22) PCT Filed: Apr. 27, 2022

(86) PCT No.: PCT/IB2022/053911

§ 371 (c)(1),
(2) Date: Aug. 3, 2023

(87) PCT Pub. No.: WO2022/229876

PCT Pub. Date: Nov. 3, 2022

(65) Prior Publication Data

US 2024/0099411 A1 Mar. 28, 2024

(30) Foreign Application Priority Data

Apr. 29, 2021 (EP) ..... 21020236
Apr. 29, 2021 (EP) ..... 21020237

(51) Int. Cl.
*A42B 3/06* (2006.01)
*A42B 3/12* (2006.01)
*A42B 7/00* (2006.01)

(52) U.S. Cl.
CPC ..... *A42B 3/124* (2013.01); *A42B 3/062* (2013.01); *A42B 3/064* (2013.01); *A42B 3/12* (2013.01); *A42B 7/00* (2013.01)

(58) Field of Classification Search
CPC ..... A42B 3/064; A42B 3/124
See application file for complete search history.

(56) References Cited

U.S. PATENT DOCUMENTS 8,316,512 B2 * 11/2012 Halldin ..... A42B 3/064 24/90.1
10,362,829 B2 * 7/2019 Lowe ..... A42B 3/128
10,398,187 B1 9/2019 Shaffer
11,147,335 B2 * 10/2021 Pomering ..... A42B 3/064
(Continued)

FOREIGN PATENT DOCUMENTS

EP 2440082 B1 3/2015
EP 3391765 A2 10/2018
(Continued)

*Primary Examiner* — Katherine M Moran
(74) *Attorney, Agent, or Firm* — Jason L DeFrancesco

(57) ABSTRACT

Helmet (1) comprising: a shell (2); a head receiving system (3); at least one cellular energy-absorbing structure (4) comprising a plurality of interconnected open-cells (9) configured to absorb energy by deforming during an impact on the shell (2); at least one clamping device (5) comprising a base (6) and a counter-base (7) connected to each other via a collapsible body (8) sized so as to enter one or more open-cells (9) of the cellular energy-absorbing structure (4); wherein the base (6) or the counter-base (7) of the clamping device (5) comprises a low friction part (26) configured to enable a relative movement of the cellular energy-absorbing structure (4) and the clamping device (5) with respect to the shell (2).

21 Claims, 5 Drawing Sheets

(56) References Cited

U.S. PATENT DOCUMENTS

| | | | | |
|---|---|---|---|---|
| 2010/0115686 | A1 | 5/2010 | Halldin | |
| 2016/0249702 | A1* | 9/2016 | Pfanner | A42B 3/125 2/416 |
| 2020/0029644 | A1 | 1/2020 | Kele | |
| 2024/0032639 | A1* | 2/2024 | Storey | A42B 3/12 |
| 2024/0099411 | A1* | 3/2024 | Storey | A42B 3/124 |

FOREIGN PATENT DOCUMENTS

| | | | |
|---|---|---|---|
| EP | 3422887 | A1 | 1/2019 |
| EP | 3583863 | A2 | 12/2019 |
| WO | 2006022680 | A1 | 3/2006 |
| WO | 2016209740 | A1 | 12/2016 |
| WO | 2017152151 | A1 | 9/2017 |
| WO | 2018231632 | A1 | 12/2018 |
| WO | 2020245609 | A1 | 12/2020 |

* cited by examiner

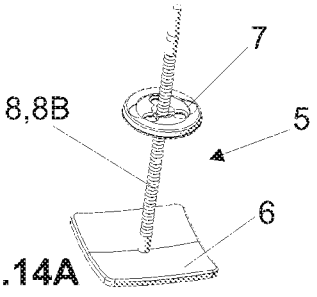
Fig.14A
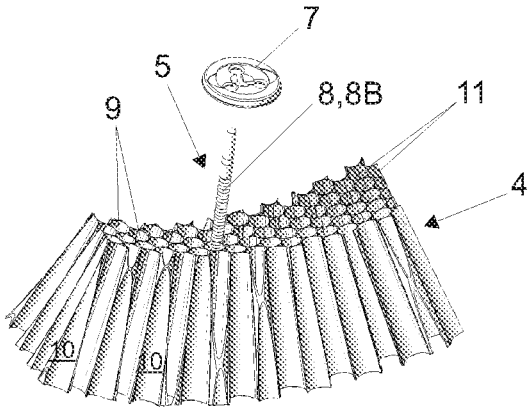
Fig.14B
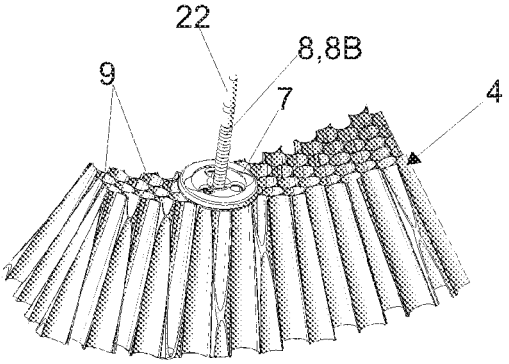
Fig.14C
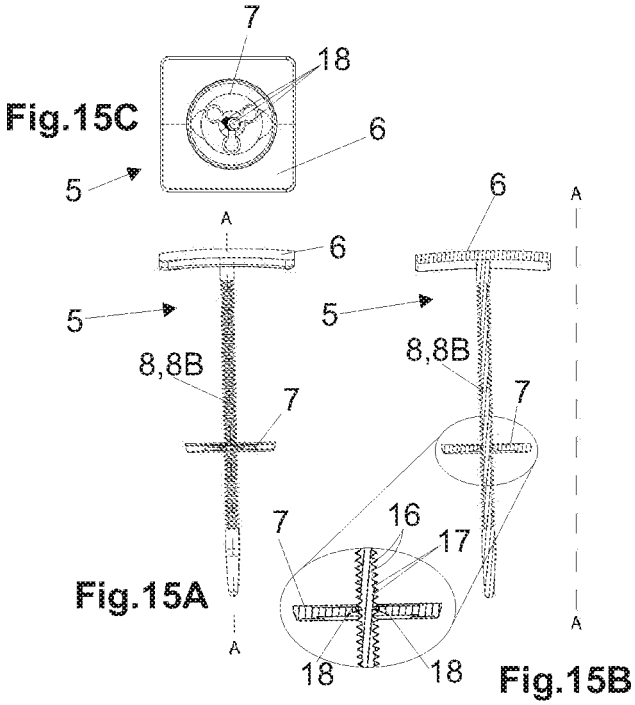
Fig.15C
Fig.15A
Fig.15B

CELLULAR ENERGY-ABSORBING STRUCTURE FASTENING DEVICE

TECHNICAL FIELD

The present invention relates to the field of helmets with cellular energy-absorbing structures. In particular, the present invention relates to the helmets using layered structures with relative movement between layers for reducing translational acceleration and angular acceleration of the brain.

BACKGROUND ART

In the state of the art several types of helmets are known: motorcycle helmets, automotive race helmets, industrial safety helmets, bike helmets, ski helmets, water-sports helmets, equestrian helmets, American football helmets, etc.

Traditional sport, car and motorcycle helmets comprise:

- an outer shell, preferably a hard shell;
- a protective liner matching with the shell and arranged into the shell;
- a comfort liner for making the helmet much more comfortable when it's worn by the user;
- a retention system, generally comprising a strap and a quick-release locking system.

Industrial safety helmets normally comprise:

- a outer hard shell;
- a harness connected to the hard shell.

The outer shell gives to the helmet a specific appearance and provides a first protection against impacts. In the helmets having a protecting liner, the shell also contains the protective liner. The material of the shell can be a polymer such as PC (polycarbonate), PE (polyethylene), ABS (acrylonitrile butadiene styrene) or a composite material such as glassfibre or carbon fibre. Depending on the material, the shell is generally thermomoulded or thermo-formed, for example in bike helmets, or injection-moulded, for example in ski helmets.

Generally, the protective liner is made of a polymeric foam, like EPS (Expanded Polystyrene) or EPP (Expanded Polypropylene), and is used for absorbing the energy generated during a collision. The EPS liner or layer absorbs the energy of an impact through compression. Currently EPS is the most used material for absorbing the energy of an impact and employed in most of helmets. Alternatively, high-performance energy-absorbing material are known, such as the energy-absorbing material distributed with brand Koroyd®. This kind of cellular energy-absorbing material absorbs much more energy than traditional EPS/EPP liners when an impact load substantially orthogonal to the shell occurs. This kind of cellular material absorbs energy through a progressive buckling of its cells.

The comfort liner can comprise pillows made of synthetic or natural material, which adheres or is connected to the internal side of the protective liner. In this way, the head of the user is not in direct contact with the protective liner but with the comfort liner that is much more comfortable. Alternatively to the comfort liner, industrial helmets have a harness, consisting of a system of straps made of woven bands or polyethylene. A harness is a cheap solution for combining a system for maintaining the helmet over the head of the wearer and a system for absorbing part of the energy of an impact. The harness absorbs less impact energy than polymeric foam liners.

The retention system is used for maintaining the helmet in position on the head of the user and can comprise a regulation device for regulating the tightening of the helmet on the head.

During an impact, for example due to a fall of a biker, the outer shell can impact against an object, like the ground, in any direction and the impact load has a normal component and/or a tangential component. The tangential component can create a rotation of the skull with respect to the brain, while the normal component can cause the skull fracture leading to death. Both kind of injuries are important and needs to be reduced as much as possible by the helmet.

In order to absorb both normal and tangential components of an impact load, the solutions available in the state of the art employ a device for absorbing the tangential component and a device for absorbing the normal component. In particular, all known solutions do not connect them together.

For example, certain helmets manufactured by the company Smith™ comprise a cellular energy-absorbing pad of the company Koroyd® and a brain protection system developed by the company MIPS®. The cellular energy-absorbing pad efficiently absorbs the normal component of impact load, while the brain protection system efficiently absorbs the tangential component. The cellular energy-absorbing pad fits in an EPS liner and the brain protection system is connected to the same EPS liner, as described by the document EP2440082B1. Said cellular energy-absorbing pad is not connected to said brain protection system and consequently they work like independent devices and not synergically.

Other solutions that solve only one of the problems of absorbing the normal component or absorbing the tangential component of an impact load are available. For example, the helmet described in the document WO2016209740A1 comprises a protective liner split in two parts, an outer liner and an inner liner. The outer liner is connected to the inner liner through an elastic band, which allows relative movements between the inner and outer liners. This feature allows to reduce rotational or translational brain injuries. This document provides a solution for dividing a protective liner in two parts for efficiently absorbing rotational acceleration due to the tangential component of an impact load, but neglects how to efficiently mitigate linear acceleration imparted by the normal impact component.

Another similar solution is provided in the document U.S. Ser. No. 10/398,187B1 which discloses two liners interconnected from outside through adjustable retainers. Even the document WO2020245609 discloses a helmet wherein the inner energy-absorbing liner is anchored to the outer shell via a connector.

Since the device for absorbing normal impact component does not cooperate with the device for absorbing the tangential impact component, the impact loads are not efficiently absorbed. Moreover, the deformation of the device for absorbing normal impact components can compromise the functionality of the other one, or vice versa. In this way, the devices theoretically work efficiently, but in practice each one affects the functioning of the other.

Furthermore, all the available solutions for sport, motorcycle and car helmets use polymeric foam liners, e.g. EPS or EPP liners, when the international rules are evolving in favour of more environment-friendly solutions, which avoid or reduce these kinds of materials.

None of the available solutions provides helmets able to efficiently absorb all kind of impacts through an integrated solution that results in a cheaper, simpler and more environmentally friendly product.

SUMMARY

Said and other inconvenients of the state of the art are now solved by a helmet comprising: a shell, at least one cellular energy-absorbing structure, at least one clamping device and a head receiving system. Said at least one cellular energy-absorbing structure comprises a plurality of interconnected open-cells configured to absorb energy by deforming during an impact on the shell; said at least one clamping device comprises a base and a counter-base connected to each other via a collapsible body. The collapsible body is sized so as to enter one or more open-cells of the cellular energy-absorbing structure. The counter-base is preferably configured to lock the at least one clamping device to the cellular energy-absorbing structure. The base or the counter-base of the clamping device comprises a low friction part configured to enable a relative movement of the cellular energy-absorbing structure and the clamping device with respect to the shell. This arrangement, if an inclined impact hits the shell, allows to the cellular energy-absorbing structure to slide over the shell thanks to the clamping device/s. Moreover, the at least one clamping device allows to support or connect other elements of the helmet, like the head retaining system. In particular, being the body of the clamping device collapsible, the clamping device follows the movements of the cellular energy-absorbing structure when it crumples, also compensating lateral movements due to the tangential component of the impact load.

Preferably, the cellular energy-absorbing structure can be an array of energy-absorbing open-cells interconnected via their sidewalls. This architecture of the cellular energy-absorbing structure is particularly efficient in absorbing axial loads, thus loads substantially parallel to the open-cells longitudinal axis. In particular, each open-cell can have an open base facing the shell and an opposite open base facing the head receiving system. This arrangement of the open-cells allows to absorb more efficiently the axial impact load through the progressive crumpling of the cells.

Alternatively, the cellular energy-absorbing structure can be a lattice structure comprising solid portions and open portions configured to form a network of interconnected open-cells. This architecture of the cellular energy-absorbing structure is particularly efficient in absorbing loads coming from any direction. In particular, the cellular energy-absorbing structure can be arranged so that one side of the structure faces towards the shell and an opposite side faces towards the head receiving system. In this way, the cellular energy-absorbing structure is arranged between the shell and the head receiving system.

Advantageously, the compressive force required to collapse the clamping device along a direction can be lower than or equal to that required to deform the open-cells of the cellular energy-absorbing structure along the same direction. This means that the clamping device does not resist when the cellular energy-absorbing structure is compressed due to an impact load and the cellular energy-absorbing structure can be compressed as if there were no clamping devices.

Preferably, the shell can comprise only a hard shell or, alternatively, a rigid or semi-rigid outer shell and an inner shock absorbing liner connected to each other. In the former case, the shell is constituted by a hard shell, as in the case of industrial helmets. In the latter case, the shell comprises an outer shell and an inner shock absorbing liner, as in the case of sport helmets. The inner shock absorbing liner is preferably made of a polymeric foam in order to absorb the impact energy by deforming. The inner shock absorbing liner can comprise at least a pocket wherein the cellular energy-absorbing structure is arranged. This pocket is configured to retain and confine the cellular energy-absorbing structure without using additional retaining devices. In this way, the cellular energy-absorbing structure and the shell remain connected independently of the clamping devices/s. When the shell comprises only a hard shell, the low friction part can be a spacer arranged between the cellular energy-absorbing structure and the hard shell, for allowing a relative sliding of the cellular structure over the hard shell.

Preferably, the head receiving system can be a harness system or a comfort system. Preferably said harness system or comfort system can be connected to the counter-base or base of the at least one clamping device. In this way, a correct positioning of the head of the wearer with respect to the helmet is guaranteed.

Preferably, the base or counter-base that does not comprise the low friction part can be connected to the head receiving system through connecting means. In this way, the clamping devices are attached to the cellular energy-absorbing structure and together they are attached to the head receiving system via the clamping devices.

Preferably, the connecting means can comprise a Velcro layer, an adhesive layer or snap-fit connector/s for simplifying the interconnection between the clamping device and the head receiving system.

Advantageously, the collapsible body that is stretchable, thus configured to appreciably and reversibly elongate with respect to its original length. This characteristic of the collapsible body allows to firmly and easily fix the clamping device to the cellular energy-absorbing structure and, optionally, to the head receiving system. This kind of single piece clamping device is elastic and can collapse and stretch so as to follow any kind of deformation of the cellular energy-absorbing structure. Preferably, said base can be rigid or semi-rigid so as to not flex when it lies over one side of the cellular energy-absorbing structure. More preferably, said rigid or semi-rigid base is co-molded with the collapsible body so to form a single piece despite of the elastic and rigid parts of the clamping device. The stretchable collapsible body is configured to elongate without permanently deforming up to a maximum elongation comprised between 150% and 500% of its original length in a tensile test.

Alternatively, the collapsible body of the clamping device/s can be inserted in a hole of the shell and the base or counter-base can abut against the external face of the shell. In this way, the base or counter-base leans on the external surface of the shell and the rest of the clamping device clamps the cellular energy-absorbing structure to the shell. In this embodiment, a plurality of low friction elements allow a relative movement between the cellular energy-absorbing structure and the shell.

Preferably, the collapsible body of the clamping device can be connected to the base and can have an outer surface comprising a plurality of spaced teeth and spaced recesses. Said counter-base can comprise at least one flexible pawl shaped so as to fit in one of said recesses. By means of this second kind of clamping device, the cellular energy-absorbing structure can be easily and quickly connected to the shell or head receiving system. The collapsible body of the clamping device allows to follow the deformations of the cellular energy-absorbing structure, in particular when it crumples.

Advantageously, this kind of clamping device can comprise a collapsible body that is at least partially pleated or coiled, or comprises geometric perturbations to facilitate the collapse of the collapsible body.

Alternatively, the base can comprise a protuberance having a plurality of teeth configured to cooperate with a mouth of a hollow body connected to the counter-base, said protuberance and said hollow body forming the collapsible body of the clamping device. This third kind of clamping device allows a facilitated axial collapsing of the collapsible body, since the protuberance enters in the hollow body in an easy way. Furthermore, the teeth prevent any rebounding of the cellular energy-absorbing structure and maintain it crumpled.

These and other advantages will be better understood thanks to the following description of different embodiments of said invention given as non-limitative examples thereof, making reference to the annexed drawings.

DRAWINGS DESCRIPTION

In the drawings:

FIGS. 1A, 2A, 3A and 4A show schematic views of a cross-sectioned helmets according to some embodiments of the present invention;

FIGS. 1B, 2B, 3B and 4B respectively show the helmet of FIGS. 1A, 2A, 3A and 4A when an inclined impact load hits the shell of the helmet;

FIG. 14A shows an axonometric view of said third type of clamping device;

FIG. 14B shows an axonometric view of the clamping device of FIG. 14A during the connection to a cellular energy-absorbing structure;

FIG. 14C shows an axonometric view of the clamping device of FIG. 14A connected to a cellular energy-absorbing structure;

FIG. 15A shows a side view of a clamping device of the third type;

FIG. 15B shows a cross-section of the clamping device of FIG. 15A;

FIG. 15C shows a top view of the clamping device of FIG. 15A;

DETAILED DESCRIPTION

Figure 1A:
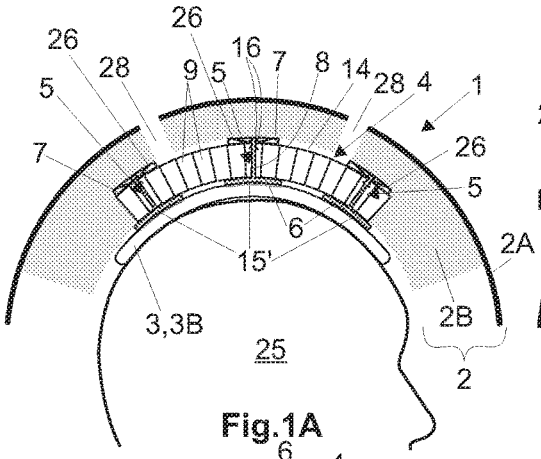

The following description of one or more embodiments of the invention is referred to the annexed drawings. The same reference numbers indicate equal or similar parts. The object of the protection is defined by the annexed claims. Technical details, structures or characteristics of the solutions herebelow described can be combined with each other in any suitable way.

In the present description, for the sake of conciseness, the term "cellular energy-absorbing structure 4" is sometime abbreviated as "cellular structure 4", as well as the term "inner shock absorbing liner 2B" is abbreviated as "inner liner 2B". Other similar abbreviations can be present in the following description.

FIGS. 1A, 2A, 3A and 4A represent some embodiments of the helmet 1 according to the present invention. This helmet 1 comprises a shell 2, at least one cellular energy-absorbing structure 4, a head receiving system 3 and one or more clamping devices 5.

As described in detail in the following, the clamping devices 5 are employed to allow a relative movement between two parts of the helmet 1 and to absorb the energy related to this movement.

Figure 2A:
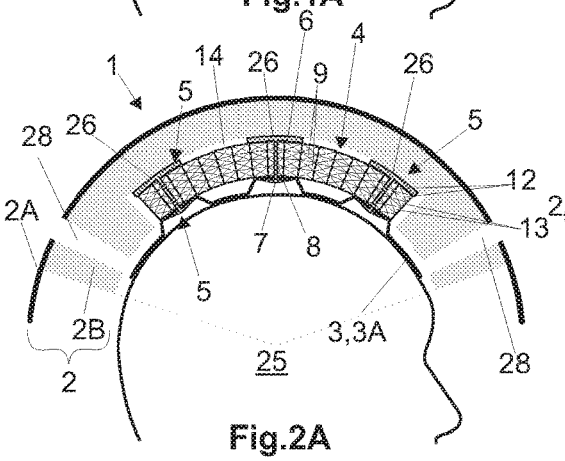

In particular, in the embodiment of FIGS. 1A and 2A the clamping devices 5 connect the cellular structure 4 to the head receiving system 3. In the embodiment of FIG. 4A the clamping devices 5 are connect only to the cellular structure 4, while in the embodiments of FIG. 3A the clamping devices 5 connect the cellular structure 4 both to the shell 2 and to the head receiving system 3.

Figure 3A:
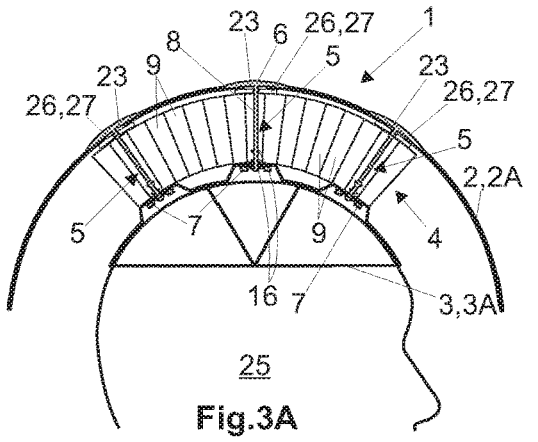
Figure 4A:
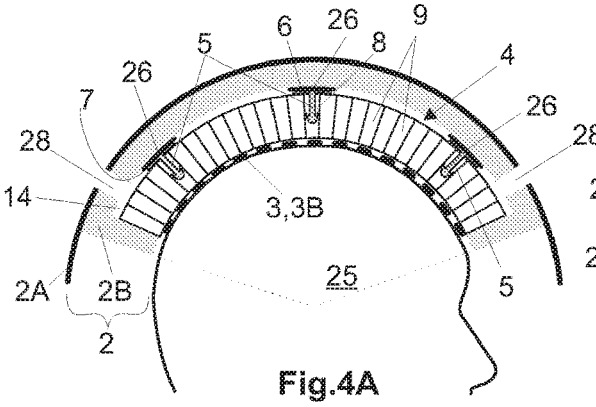
Figure 4B:
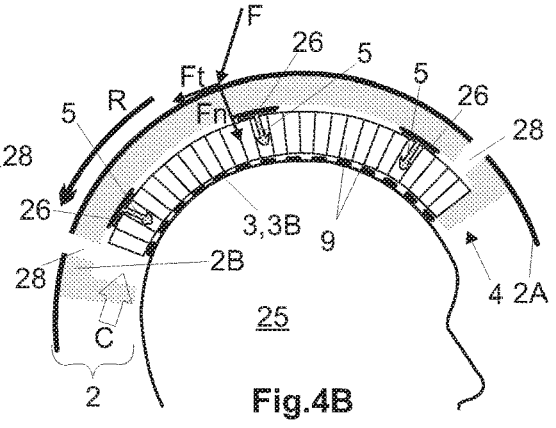

In the embodiments of FIGS. 1A, 2A and 3A, the clamping device 5 is configured to pass-through the thickness of the cellular structure 4, from side to side. The clamping device 5 comprises a base 6, a counter-base 7 and a collapsible body 8 connecting them to each other. The base 6 and the counter-base 7 are opposite to each other with respect to the cellular structure 4. The collapsible body 8 is sized so as to enter and pass through one open-cell 9 of the cellular structure 4, as shown in FIGS. 1A, 3A and 4A, or through a plurality of open-cells 9, as shown in FIG. 2A. The collapsible body 8 cross-section is thus smaller than the open-cell 9 cross-section.

The embodiment of FIG. 4A shows a clamping device that is not configured to cross the cellular energy-absorbing structure 4. This clamping device 5 acts as a plug that enters in an open-cell 9 of the cellular structure 4, as better described in the following.

The collapsible body 8 of the clamping device can be made, at least in part, of a polymeric material. When a mechanical interaction with the counter-base 7 is required like in the embodiments of FIGS. 1A and 3A, the material of the collapsible body 8 is a plastic material, like polyethylene or nylon. Vice versa, if a mechanical interaction with the counter-base 7 is not required, as described for the clamping device 5 of FIG. 2A or 4A, the collapsible body 8 is made of an elastic material, for example rubber, thermoplastic polyurethane (TPU), thermoplastic elastomer (TPE), silicone or another elastomeric material.

As shown in the embodiments of FIGS. 1A, 3A and 4A, the cellular structure 4 comprises an array of energy-absorbing open-cells 9. These open-cells 9 are connected to each other via their sidewalls 10.

The open-cells 9 are open at their ends so that each open-cell 9 realizes a tube through which the air can flow. The open-cell 9 has a circular cross-section as represented in FIGS. 14 and 16. Alternatively, the cross-section of the open-cells 9 can be a square, a hexagon, a non-uniform hexagon, a re-entrant hexagon, a chiral truss, a diamond, a triangle or an arrowhead.

The open-cells 9 of said array can be welded to each other via their sidewalls 10. Alternatively, the tubes can be bonded by means of adhesive layers interposed between adjacent sidewalls 10. This kind of adhesive can be a thermo-adhesive material, thus an adhesive that at room temperature is solid and becomes liquid e.g. above 80-100° C. Otherwise, the adhesive could also be a reactive adhesive or pressure sensitive adhesive.

When the open-cells 9 have a circular cross-section, the outer diameter of the circular cross-section can range between 2.5 and 8 mm, and the wall thickness of said open-cells 9 can range between 0.05 and 0.2 mm.

The array of energy-absorbing open-cells 9 can be configured to absorb the energy through a plastic deformation of the sidewalls 10 of the open-cells 9, wherein "plastic deformation" means that the sidewalls 10 crumple irreversibly, or through an elastic deformation of the sidewalls 10 of the open-cells 9. In the latter case, the deformation is almost completely reversible and the sidewalls 10 come back to a shape equal to the original one.

Alternatively, the open-cells 9 can be the cells of a lattice structure, as schematically shown in FIG. 2A. In this case, the open-cells 9 are constituted by hollow portions defined by the solid portions 12 of the lattice structure. Substantially, the three-dimensional grid of solid portions 12 of the lattice structure defines a network of interconnected open-cells 9 (i.e. the hollow portions of the lattice structure), through which the air can flow. These open portions 13 of the lattice structure realize said open-cells 9. The lattice structure 4 can be configured to absorb the energy through a plastic or elastic deformation of the solid portions 12.

It's useful to clarify that a cellular structure 4 preferably has not wide cells, otherwise the energy-absorption is compromised and the cellular structure 4 becomes too soft for absorbing compressive loads. Consequently, the clamping devices 5 comprise slender collapsible bodies 8 for allowing the insertion into said openings 11 and the passage through the open-cell/s 9. If the energy-absorbing structure would be made of an expandable foam, like in the prior art solution, the hole for receiving the plug could be sized at will. Vice versa, in the present solutions, the cellular structure 4 imposes the dimension of the connecting device 5 and not conversely.

The cellular structure 4, both in the version having an array of energy-absorbing open-cells 9 and in the lattice structure, comprises a surface facing towards the shell 2 and a surface facing towards the head receiving system 3, as shown in FIGS. 1, 2, 3 and 4. These surfaces comprise a plurality of openings 11 of said open-cells 9. In any one of these openings 11, the connecting devices 5 can be inserted.

With reference to FIG. 1A, it's represented a helmet 1 comprising a shell 2 composed by an outer shell 2A and an inner shock absorbing liner 2B. The helmets of the embodiments of FIGS. 1A, 2A and 4A are suitable for sport helmets, the outer shell 2A can be rigid, like in the motorcycle or automotive helmets, or semi-rigid, like in the bike or ski helmets.

The inner shock absorbing liner 2B is preferably made of an expanded foam polymer, like EPS or EPP.

In the embodiment of FIG. 1A, the inner liner 2B comprises a pocket 14 in which the cellular structure 4 is arranged. The pocket 14 is a recess of the inner surface of the inner liner 2B. This pocket 14 is shaped so as to be substantially complementary to the cellular structure 4. In this way, the cellular structure 4 is retained in the pocket 14 without additional connecting means. The pocket 14 has inner mouth that is smaller than its bottom surface, consequently once the cellular structure 4 is arranged in this pocket 14, it cannot come out. The outer shell 2A and the inner liner 2B comprise a plurality of vents 28. A vent 28 is an opening that allows an air transit from the external environment to the head 25 of the wearer. The vent 28 crosses the outer shell 2A and inner liner 2B up to the bottom of the pocket 14. From here, the air can reach the head 25 thanks to the open-cells 9 of the cellular structure 4. The helmet 1 is thus permeable. The clamping devices 5 are configured to cross the cellular structure 4 from one side to the other, and their collapsible bodies 8 are configured to penetrate in respective open-cells 9 of the cellular structure 4. The clamping devices 5 are inserted in the cellular structure 4 so that the bases 6 face towards the head receiving system 3 and the counter-bases 7 faces towards the bottom of the pocket 14. The counter-bases 7 are preferably disks made of nylon, polycarbonate or PTFE (polytetrafluoroethylene) acting as low friction part 26 of the clamping device 5. The collapsible bodies 8 can be connected to the counter-bases 7 once they come over the cellular structure 4. The connection between this kind of counter-base 7 and the collapsible body 8 is described in the following with reference to the clamping devices 5 of FIGS. 14 and 15. Thanks to the counter-bases 7, the cellular structure 4 is spaced with respect to the bottom of the pocket 14 and does not enter in contact with it. The bases 6 are connected to the head receiving system 3 through connecting means 15. In this embodiment, the connecting means 15 are a Velcro connection and the head receiving system 3 a comfort system 3B. The Velcro connection comprises a hooking part and a hook part structured in a known manner. The hook part is preferably arranged on the base 6, and the comfort system 3B comprises an outer woven cover that acts a hooking part. In this type of helmet 1, the head receiving system 3 can move with respect to the cellular structure 4 and the cellular structure 4 can slide over the bottom of the pocket 14 as explained later on in the description.

With reference to FIG. 2A, it's represented a helmet 1 comprising a shell 2 composed by an outer shell 2A and an inner liner 2B as explained for the helmet 1 of the embodiment shown in FIG. 1A. In this case the vents 28 are arranged not in correspondence of the cellular structure 4, but in a further embodiment (not shown) they can be arranged in correspondence of the cellular structure 4 so that an airflow cross all the elements of the helmet 1. In this embodiment, the cellular structure 4 is a lattice structure, as described above. The collapsible bodies 8 of the clamping devices 5 pass-through a plurality of open-cells 9 in order to come over from the opposite side of the cellular structure 4. The bases 6 of these clamping devices 5 stay on the outer side of the cellular structure 4 and lie on it, while the counter-bases 7 are arranged over the head receiving system 3. Substantially, the collapsible bodies 8 cross the open-cells 9 and the head receiving system 3. In this way, the counter-bases 7 lie on the inner surface of the head receiving system 3, as shown in FIG. 2A. In this version of the helmet 1, the clamping devices 5 clamp the head receiving system 3 and the cellular structure 4 together. Furthermore, the clamping devices 5 comprise respective low friction element 26 arranged on the outer surfaces of the bases 6. This low friction element 26 can be a layer made of nylon, polycarbonate or PTFE for reducing the friction between the bases 6 and the bottom of the pocket 14. In this way, the cellular structure 4 can slide over the inner liner 2B. The head receiving system 3 of this embodiment is a harness system 3A of a different type with respect to the head receiving system 3 of FIG. 1A. The clamping device 5 can be like that explained in the following with reference to FIG. 6.

With reference to FIG. 3A, it is represented a helmet 1 comprising an outer shell 2A and head receiving system 3 connected to each other through clamping devices 5. The shell 2 of this embodiment consists only of an outer shell 2A, thus a hard shell made of a rigid plastic that is able to resist impacts. The cellular structure 4 is clamped between the outer shell 2A and the head receiving system 3, thanks to clamping devices 5. The clamping devices 5 are configured to pass with their collapsible bodies 8 through respective holes 23 in the outer shell 2A and penetrate respective open-cells 9 of the cellular structure 4. The clamping devices 5 are also configured to pass through the head receiving system 3 and to mechanically connect to it with the counter-bases 7. The counter-base 7 is configured to pass through a cell 9 of the cellular structure 4 and to expand outwardly once it is on the other side of the cellular structure 4. The counter-bases 7 are arranged over the head receiving system 3, so that the head receiving system 3 remains clamped between the counter-bases 7 and the cellular structure 4. Between the cellular structure 4 and the outer shell 2A a plurality of spacers 27 are arranged. The spacers 27 are rings of nylon or PTFE and acts as low friction parts 26 of the helmet. The spacers 27 are arranged so as to stay between the inner surface of the outer shell 2A and the outer face of the cellular structure 4. In this way, the spacers 27 act as cushions between the outer shell 2A and the cellular structure 4, allowing relative sliding. The clamping devices 5 penetrate respective spacers 27 in order to avoid they escape from the helmet 1. In this embodiment, the head receiving system 3 is a harness system 3A, that is slightly different from that of FIG. 2A, and allows a fine positioning of the head 25 in the helmet 1. This kind of helmet 1 allows a relative movement of the head receiving system 3 and cellular structure 4 with respect to the outer shell 2A thanks to the flexibility of clamping devices 5 and spacers 27.

With reference to FIG. 4A, the helmet 1 comprises a shell 2 having an outer shell 2A and inner shock absorbing liner 2B. In particular, the outer shell 2A is connected to the inner liner 2B through an adhesive (not shown) or another type of connection. The inner liner 2B is thus firmly connected to the outer shell 2A. The inner liner 2B comprises a pocket 14 in which the cellular structure 4 is arranged. The pocket 14 is a recess of the inner surface of the inner liner 2B. This pocket 14 is shaped so as to be substantially complementary to the cellular structure 4. In this way, the cellular structure 4 is retained in the pocket 14 without additional connecting means, as already described for the embodiment of FIG. 1A. The outer shell 2A and the inner liner 2B comprise a plurality of vents 28. The vent 28 crosses the outer shell 2A and inner liner 2B up to the bottom of the pocket 14. From here, the air reaches the head 25 thanks to the open-cells 9 of the cellular structure 4. The helmet 1 is thus permeable. The connecting device 5 of this embodiment is shaped like a plug and its counter-base 7 is configured to remain into an open-cell 9 of the cellular structure 4. The head of this plug, thus the counter-base 7 of the clamping device 5, is made of a soft material and its size is bigger than the cross-section area of the cell 9, consequently, this head exercises a friction on the inner surface of the cell 9, allowing to couple the clamping device 5 to the cellular structure 4. Over the outer surface of the base 6 is arranged the low friction part 26 of the clamping device 5. This low friction part 26 is a thin layer of nylon, polycarbonate or PTFE (polytetrafluoroethylene). In this way, the base 6 can slide over the bottom of the pocket 14 without difficulties. Moreover, due to the thickness of the base 6, the cellular structure 4 is kept spaced from the bottom of the pocket 14. The base 6 having said low friction part 26 acts as a skate and allows a relative movement between the cellular structure 4 and the inner liner 2B. In this way, the cellular structure 4 is slidingly connected to the inner liner 2B. The helmet 1 also comprises a comfort system 3B, similar to that of FIG. 1A, arranged between the head 25 and the cellular structure 4, for making the helmet 1 more comfortable.

FIGS. 5-13 show some types of clamping devices and how they interact with the cellular structure 4. Over their bases 6, even if it's not depicted, a low friction part/layer 26 can be arranged.

Figure 5A:
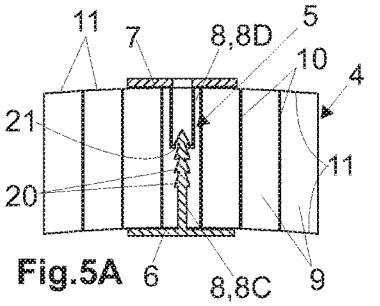
FIGS. 5A, 5B and 5C show a schematic view of a cellular energy-absorbing structure and a clamping device of a first type respectively before being compressed, after a compression due to a normal load, and after a compression due to an inclined load.
Figure 5B:
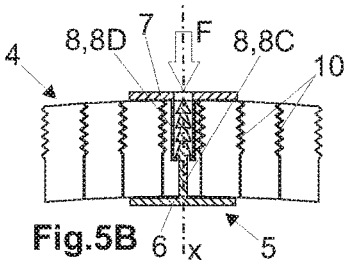
Figure 5C:
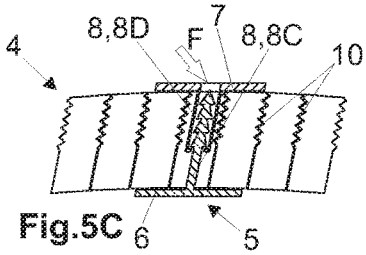
Figure 6A:
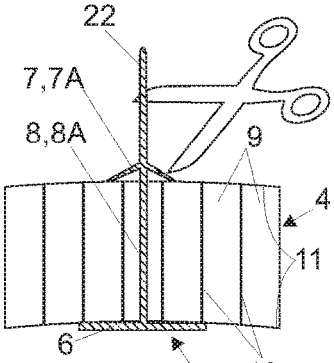
FIGS. 6A, 6B, 6C and 6D shows a schematic view of a cellular energy-absorbing structure and a clamping device of a second type respectively during the assembling phase, before being compressed, after a compression due a normal load and after a compression due to an inclined load.
Figure 6B:
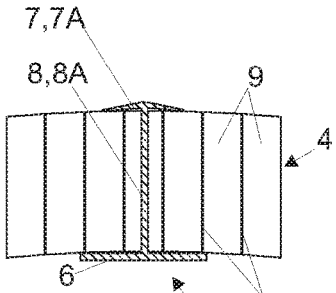
Figure 6C:
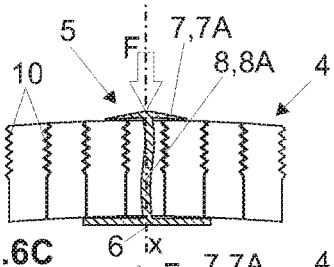
Figure 6D:
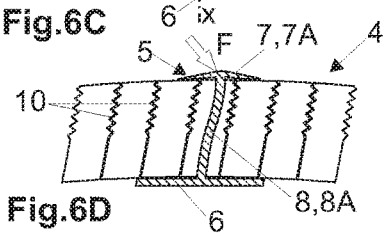
Figure 7A:
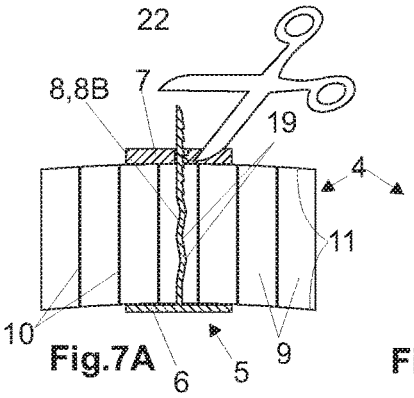
FIGS. 7A, 7B, 7C and 7D shows a schematic view of a cellular energy-absorbing structure and a clamping device of a third type respectively during the assembling phase, before being compressed, after a compression due a normal load and after a compression due to an inclined load.
Figure 7B:
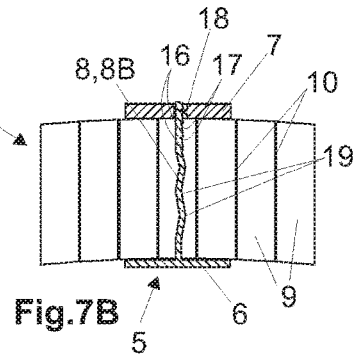
Figure 7C:
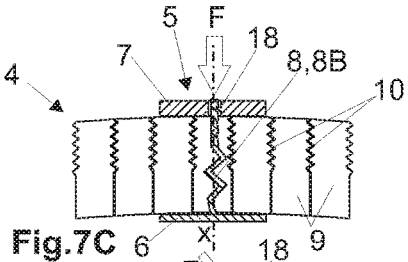
Figure 7D:
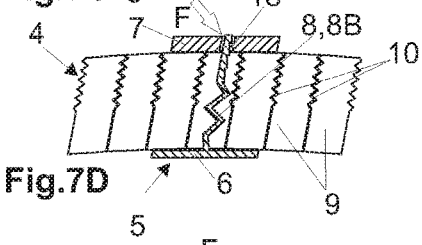
Figure 8A:
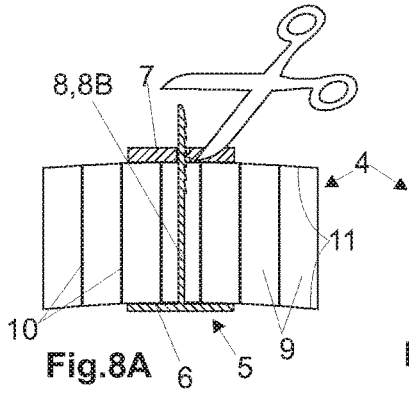
FIGS. 8A, 8B, 8C and 8D shows a schematic view of a cellular energy-absorbing structure and a clamping device of a fourth type respectively during the assembling phase, before being compressed, after a compression due a normal load and after a compression due to an inclined load.
Figure 8B:
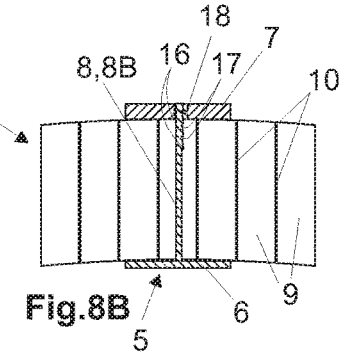
Figure 8C:
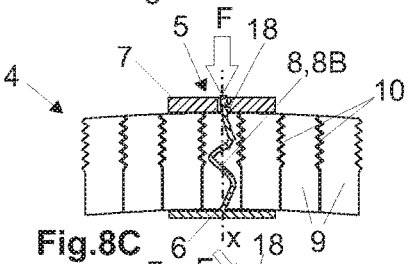
Figure 8D:
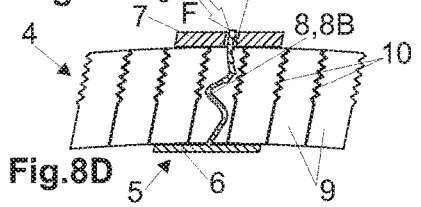

The clamping device of FIG. 5 comprises a base 6 having a protuberance 8C and counter-base 7 comprising a hollow body 8D. The protuberance 8C and the hollow-body 8D constitute the collapsible body 8. The protuberance 8C is shaped so as to enter in the hollow body 8D through the mouth 21. The protuberance 8C comprises a dentition 20 that is configured to cooperate with the mouth 21 of the hollow body 8D, so to make the extraction of the protuberance 8C from the hollow body 8D not possible or difficult. The counter-base 7 is shaped so to lie on one side of the cellular structure 4, while the base 6 is shaped so to lie on the opposite side of the cellular structure 4. The hollow body 8D and the protuberance 8C are dimensioned so as to enter in one single open-cell 9, without the need of creating a wider pass-through hole or enlarging the existing one. As shown in FIG. 5B, when a normal and out-of-plane force F is applied to the cellular structure 4 and to the clamping device 5, the open-cells 9 progressive buckle and their sidewalls 10 crumple. The clamping device 5 is configured so that the collapsible body 8 of the clamping device 5 follows this collapse without opposing resistance. When an angled force F is applied to the cellular structure 4, as shown in FIG. 5C, the cellular structure 4 also slightly laterally buckles and the counter-base 7 translates with respect to the base 6. Even in this case, the clamping device 5 follows this movement through a deformation. This deformation of the clamping device 5 allows to absorb the tangential component of the impact force F.

The clamping device 5 of FIG. 6 comprises a collapsible body 8A that is stretchable and is attached to the base 6. Said stretchable collapsible body 8A comprise a retaining portion which acts as counter-base 7. The stretchable collapsible body 8A is made of an elastic material so that it can get longer. In particular, the length of the stretchable collapsible body 8A can appreciably elongate and once a tension, that elongates it, is released, the stretchable collapsible body 8A returns to its original length. The stretchable collapsible body 8A also comprises an exceeding portion 22 which extends beyond the counter-base 7. In order to let pass the stretchable collapsible body 8A through one open-cell 9, the exceeding portion 22 is inserted in the open base 11 of said one open-cell 9 and once, it comes over the opposite side of the cellular structure 4, the exceeding portion 22 is pulled until the counter-base 7, passing through the open-cell 9, comes out from said opposite side. The stretchability of counter-base 7 allows the passage through one open-cell 9. At this point, the exceeding portion 22 is released and the elasticity of the stretchable collapsible body 8A spreads the retaining portion 7 over said opposite side of the cellular structure 4. In this way, the clamping device 5 exerts a force that attracts the counter-base 7 and the base 6 towards each other. After the positioning phase described above and schematically represented in FIG. 6A, the exceeding portion 22 is cut, e.g. with scissors, and the clamping device 5 looks as in FIG. 6B. This kind of clamping device 5 can change its shape and follow the deformations of the cellular structure 4. For example, in FIG. 6C a force F applies orthogonally to the cellular structure 4 and the open-cells 9 axially crumple. In this case, the stretchable collapsible body 8A relaxes, getting shorter. If the impact force F is angled, as shown in FIG. 6D, the cellular structure 4 also translates and slightly bends laterally. In this case, the clamping device 5 deforms, allowing this translation/deformation of the cellular structure 4.

Alternatively, the stretchable collapsible body 8A of the clamping device 5 is made at least in part of a viscoelastic polymer. In particular, the stretchable collapsible body 8A can be entirely made of a viscoelastic polymer or can comprise an outer elastic portion inside which is arranged a viscoelastic material, for example a viscoelastic foam.

The clamping device 5 of FIGS. 7 and 8 are substantially equal, except for the presence of geometric perturbations 19 on the collapsible body 8 of the embodiments of FIG. 7. For this reason, these embodiments of the clamping device 5 of FIGS. 7 and 8 are described together. The collapsible body 8 of these embodiments comprises a flexible collapsible body 8B that is connected to the base 6. This flexible collapsible body 8B is made of a plastic material and is configured to be flexible but not stretchable. Only a portion of the flexible body 8B can be configured to elongate in case of a pulling force greater than a certain threshold. This elongation of the flexible body 8B of these clamping devices 5 corresponds to a permanent deformation, that is different from the elastic deformation of the clamping device of FIG. 6. The outer surface of the flexible collapsible body 8B comprises a plurality of spaced teeth 16 alternated by recesses 17. The flexible collapsible 8B looks similar to a cable-tie. Said teeth 16 are configured to mechanical cooperate with at least one flexible pawl 18 belonging to the counter-base 7. The flexible pawl 18 is shaped so as to fit in one of said recesses 17 making the extraction of the flexible collapsible 8B from the counter-base 7 unfeasible or really difficult. Consequently, the flexible collapsible body 8B enters in the counter-base 7 but cannot be extracted. Once one of the teeth 16 has engaged the flexible pawl 18 of the counter-base 7 and reached the right portion, the portion of the flexible collapsible 8B coming out from the counter-base 7 is removed, for example with scissors, as shown in FIGS. 7A and 8A. The clamping devices 5 so look like those in FIGS. 7B and 8B. As shown in FIGS. 7C and 8C, when a normal and out-of-plane force F is applied to the cellular structure 4, the open-cells 9 progressively buckle and their sidewalls 10 crumple. The flexible collapsible body 8B of the clamping device 5 is configured to flex, following the collapse of the cellular structure 4 without opposing a resistance. When an angled force F is applied to the cellular structure 4, as shown in FIGS. 7D and 8D, the cellular structure 4 also slightly lateral buckles and the counter-base 7 translates with respect to the base 6. Even in this case, the clamping device 5 follows this movement through a deformation. This deformation of the clamping device 5 allows to absorb the tangential component of the impact force F. In particular, the embodiment of FIG. 7 has a flexible collapsible body 8B at least partially pleated. These geometric perturbations 19 facilitate the collapse of the collapsible body 8. Alternatively, in an embodiment not shown, the flexible collapsible body 8B can be coiled instead of pleated.

Advantageously, in one or all the embodiments of the above-described clamping device 5, the collapsible body 8 of the clamping device 5 is configured to not impede the collapsing of the cellular structure 4. In particular, the compressive force required to collapse the clamping device 5 along a direction X, as shown in FIGS. 5B, 6C, 7C, 8C, is lower than or equal to the compressive force required to deform the open-cells 9 of the cellular energy-absorbing structure 4 along the same direction X.

Alternatively to the clamping devices of FIGS. 5-8, the clamping device 5 can be shaped like a plug, as FIGS. 9-13 show.

Figures 9A, 9B, 9C, 9D, 10A, 10B, 10C, 10D, 11A, 11B, 11C, 11D, 12A, 12B, 12C, 12D, 13A, 13B, 13C, 13D:
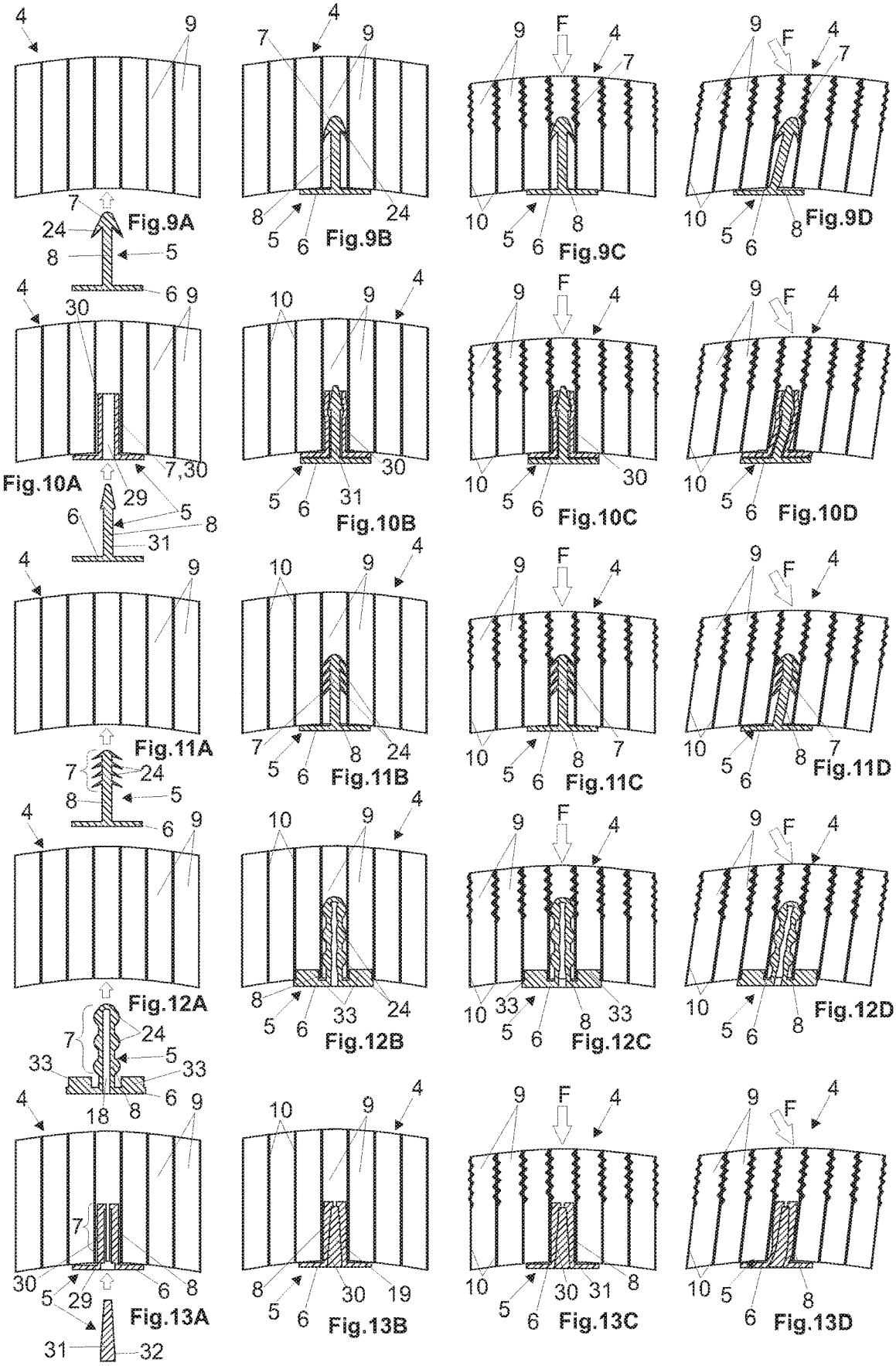
FIGS. 9A, 9B, 9C and 9D shows a schematic view of a cellular energy-absorbing structure and a clamping device of a fifth type respectively during its insertion in the cellular energy-absorbing structure, before being compressed, after a compression due to a normal load, and after a compression due to an inclined load.
FIGS. 10A, 10B, 10C and 10D shows a schematic view of a cellular energy-absorbing structure and a clamping device of a sixth type respectively during its insertion in the cellular energy-absorbing structure, before being compressed, after a compression due to a normal load, and after a compression due to an inclined load.
FIGS. 11A, 11B, 11C and 11D shows a schematic view of a cellular energy-absorbing structure and a clamping device of a seventh type respectively during its insertion in the cellular energy-absorbing structure, before being compressed, after a compression due to a normal load, and after a compression due to an inclined load.
FIGS. 12A, 12B, 12C and 12D shows a schematic view of a cellular energy-absorbing structure and a clamping device of an eighth type respectively during its insertion in the cellular energy-absorbing structure, before being compressed, after a compression due to a normal load, and after a compression due to an inclined load.
FIGS. 13A, 13B, 13C and 13D shows a schematic view of a cellular energy-absorbing structure and a clamping device of a ninth type respectively during its insertion in the cellular energy-absorbing structure, before being compressed, after a compression due to a normal load, and after a compression due to an inclined load.

In particular, the counter-base 7 can comprises one or more gripper elements 24 that extend radially outward from the cylindrical body of the collapsible body 8, as FIG. 9 depict. The gripper element 24 can be an annular fin. Alternatively, the fin can be composed by several petals (not shown). The arrow-shaped gripper element 24 is oriented so to facilitate the entrance in the open-cell 9 and to grab on to the inner surface of the open-cell 9 when pulled out. The cellular structure 4 can deform, as shown in FIGS. 9C,9D, and nevertheless the clamping device 5 follows its deformation.

In FIGS. 10, it's shown a further type of the clamping device 5. In this case, the clamping device 5 is composed by two elements, an insert element 31 and a holed body 30, the former representing the base 6 and the latter representing the counter-base 7 of the clamping device 5. The holed body 30 comprises an axial bore 29 into which the insert element 31 can be inserted. The distal end of the insert element 31 is sharped so to facilitate the entry in said axial bore 29. This end is also wider than the trunk of the insert element 31, so to push radially outside the sidewall of the holed body 30.

The axial bore 29 is stricter than the sharped end of the insert element 31. The insert element 19 is inserted in the holed body 30 only once the holed body has been inserted in the open-cell 9 of the cellular body 4. In this way, the holed body expands outwardly, squashing it against the inner surface of the open-cell 9. In this embodiment, both the insert element 31 and the holed body 30 are preferably made of a flexible material like an elastomer. In particular, the face of the base 6 facing outwardly with respect to the cellular structure 4 is that of the insert element 31 wherein a layer of low friction material can be arranged. Similarly, the trunks of the holed body 30 and of the insert element 31 constitute the expandable collapsible body 8 of the clamping device 5. Even this type of clamping device 5 is configured to follow the deformation of the cellular structure 4 without interfering, as shown in FIGS. 10C,10D.

The clamping device 5 of FIG. 11 is similar to that of the embodiment shown in FIGS. 9, but several layers of gripper elements 24 are present. These gripper elements 24 are thinner than those of FIG. 9, and consequently more flexible. Vice versa, they are more and consequently exert more grip on the inner surface of the open-cell 9.

The further type of the clamping device 5 depicted in FIG. 12 comprises an axial bore 29 and gripper elements 24 larger than the open-cell 9 width. The gripper elements 24 represent the counter-base 7 of the clamping device 5. In this way, the axial bore 29 allows an inward deformation of the collapsible body 8 in correspondence of said gripper elements 24. Vice versa, the elasticity of the elongated body 8 material exerts a radial outwardly push on the inner surface of the open-cell 9. The clamping device 5 of FIG. 12 also comprise positioners 33 configured to be inserted in respective open-cells 9 of the cellular structure 4. These positioners 33 are pins protruding from the base 6 and shaped so to enter in respective open-cells 9. These positioners 33 allow to avoid rotations of the clamping device 5 about its axis of symmetry. The clamping device 5 can comprise only one positioner 33. Even the other types of clamping device 5 can comprise one or more positioners 33.

The last type of clamping device 5 of FIG. 13 is similar to that of FIG. 10. In this embodiment, the insert element 31 has a tapered portion 32. In this way, when the insert element 31 penetrates the axial bore 29 of the holed body 30, the holed body 30 expands outwardly, compressing the inner surface of the open-cell 9. Alternatively, the tapered portion 32 can be arranged in the holed body 30. In this case, the axial bore 29 is tapered and the trunk of the insert element 31 is cylindrical. In this embodiment of the clamping device 5, the base 6 is constituted by the base portion of the holed body 30. The collapsible body 8 of the clamping device 5 of this embodiment is composed by the trunk of the holed body 30 and by the insert element 31. Some small gripper elements can be arranged on the outer surface of the holed body 30 so as to form the counter-base 7 of the clamping device 5. In this version of the clamping device 5, at least the holed body 30 is made of an elastic material.

As shown in all FIGS. 9-13 having suffix "C" or "D", the clamping device 5 always follows the axial crumpling of the cellular body 4, see FIGS. 9C,10C,11C,12C,13C, and the lateral bending of the cellular structure 4, see FIGS. 9D,10D, 11D,12D,13D.

As shown in FIGS. 9-13, the clamping device 5 is always shorter than the cellular structure 4. This means that the height of the collapsible body 8 is smaller than the cellular structure 4 thickness. In this way, even if the energy-absorbing structure 4 is axially compressed, the distal end of the clamping device 5 does not come out from the cellular structure 4. Consequently, any interference of the clamping device 5 with the wearer's head 25 is avoided. Alternatively, the collapsible body 8 of the clamping device 5 can be made of a flexible material, so that, even if its end comes into contact with the wearer's head, it does not become risky.

Even if it's not represented, the same architectures of the clamping device 5 can be used with a lattice structure. In this case, the cellular structure 4 has more open portions and the clamping device 5 can be inserted in one or more of these open-cells and can expand, as described above, for frictionally engaging the lattice structure.

In the FIGS. 1B, 2B, 3B and 4B, the helmets 1 of the embodiments of FIGS. 1A, 2A, 3A and 4A are represented during an impact with an inclined force F hitting the outer shell 2A.

Figure 1B:
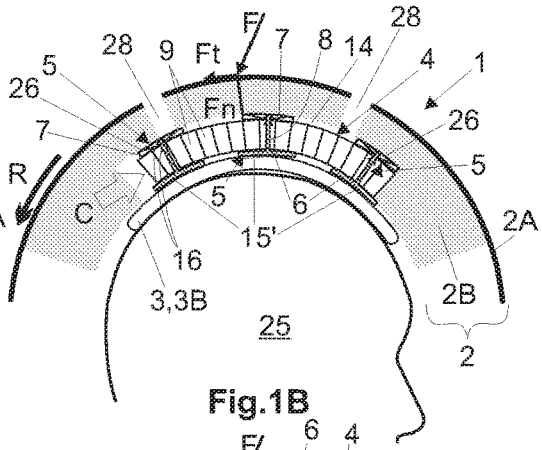

In particular, in FIG. 1B it is represented the helmet 1 of the embodiment of FIG. 1A during an impact. The impact is represented through an inclined force F which causes a rotation R of the shell 2 with respect to the head 25 of the wearer. In this case, the cellular structure 4 slides thanks to the counter-bases 7 over the bottom of the pocket 14. Consequently, the cellular structure 4 deforms along both in-plane (C) and out-of-plane directions. The cellular structure 4 hits against the sidewall of the pocket 14 and it compresses. The consequent deformation of the cellular structure 4 that occurs parallel to the bottom of the pocket 14 absorbs most of tangential component Ft of the force F. While the axial crumpling of the open-cells 9 absorbs the normal component Fn of the force F. Moreover, the clamping devices 5 bend contributing to absorb the tangential component Ft of the force F during the cellular structure 4 deformation. The crumpling of the open cells 9 is represented through a reduction of the thickness of the cellular structure 4.

Figure 2B:
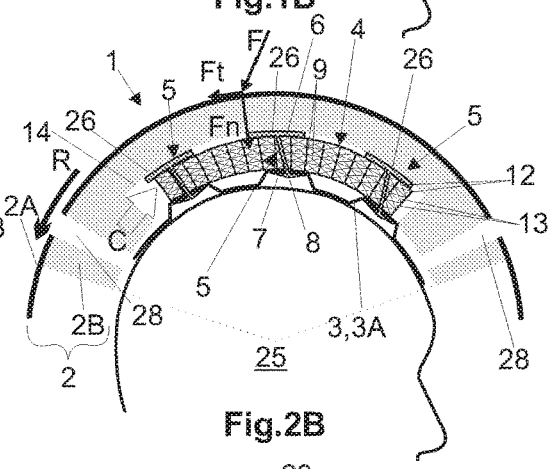

FIG. 2B shows the helmet 1 of the embodiment of FIG. 1B during an angled impact with a force F, which causes a rotation R of the shell 2 with respect to the head 25 of the wearer. In this case, the lattice structure 4 slides over the bottom of the pocket 14 by means of low friction elements 3 arranged over the outer surfaces of the bases 6. Therefore, the cellular structure 4 deforms along both in-plane (C) and out-of-plane directions. The cellular structure 4 hits against the sidewall of the pocket 14 and it compresses. The lattice structure slides in the pocket 14 deforming the solid portions 12 and absorbing most of tangential component Ft of the force F. Concurrently, the top-down crumpling of the open-cells 9 absorbs the normal component Fn of the force F. Moreover, the clamping devices 5 bend contributing to absorb the tangential component Ft of the force F during the lattice structure deformation.

Figure 3B:
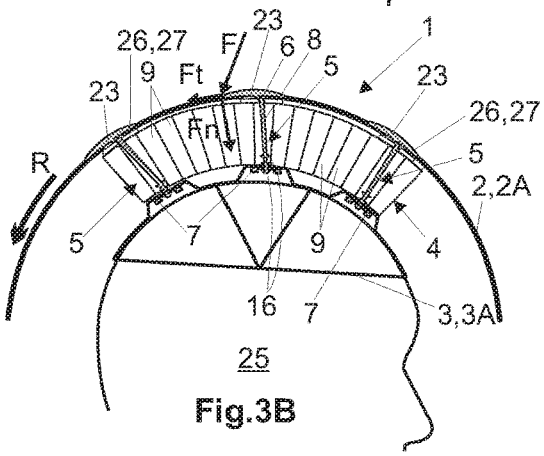

FIG. 3B shows the helmet 1 of the embodiment of FIG. 3A during an angled impact with a force F which causes a rotation R of the outer shell 2A with respect to the head 25 of the wearer. The deformation of the cellular structure 4 and of the clamping devices 5 is similar to that described for FIGS. 1B and 1C. The open-cells 9 of the cellular structure 4 axially progressive buckle absorbing the normal component Fn of the force F and, in the same time, the clamping devices 5 bend and stretch absorbing the tangential component Ft of the force F. In particular, the spacers 27 allows the cellular structure 4 to slide over the inner surface of the outer shell 2A, dissipating additional energy of the tangential component Ft.

The clamping device 5 of FIG. 14 comprises a base 6 monolithically connected to the flexible collapsible body 8B. A separated counter-base 7, comprising a plurality of pawls 18, can be inserted over the flexible collapsible body 8B, as shown in FIG. 14A. The shape of the clamping device 5 of FIG. 14 is shown in detail in FIG. 15. The counter-base 7 comprises three flexible pawls 18 and a central hole dimensioned for receiving the flexible collapsible body 8B with its teeth 16. The teeth 16 are interspersed with recesses 17. The teeth 16 interact with the flexible pawls 18 so that the latter can fit in one of said recesses 17. Once that the flexible pawls 18 enter in one recess 17, the counter-base 7 keeps its position along the flexible collapsible body 8B, as shown in the zoomed portion of FIG. 15B. The base 6 is wider than the counter-base 7 and it's slightly curved. The base 6 and the flexible collapsible body 8B are a single piece made of the same material, while the counter-base 7 is independent from them and can be made, or not, of the same material.

Over the base 6 of the clamping device of FIG. 14 can be arranged a layer of low friction material. Alternatively, the base 6 can be made of a low friction material like nylon or PTFE.

The cellular structure 4 is arranged over the shell 2 (not shown). The flexible collapsible body 8B passes-through and comes over one of the open-cells 9 of the cellular structure 4, as shown in FIG. 14B. The clamping device 5 is then secured to the cellular structure 4 inserting the counter-base 7 over the flexible collapsible body 8B so as to lock the cellular structure 4 to the clamping device 5. Finally, the exceeding part of the flexible collapsible body 8B is cut.

FIG. 14 refer to a cellular structure 4 comprising an array of energy-absorbing open-cells 9, but the same considerations apply in case of a lattice structure.

With reference to FIG. 16 an example of clamping device 5 shaped like a plug is shown. This clamping device 5 comprises a base 6 and a collapsible body 8 protruding from said base 6 like a mushroom.

The collapsible body 8 can comprises a counter-base 7 having a plurality of gripper elements 24 that extend radially outward from the cylindrical body of the collapsible body 8. The gripper elements 24, representing the counter-base 7 of the clamping device 5, can be annular fins having various forms. Alternatively, each fin can be composed by several petals (not shown) instead of being annular.

Figure 16A:
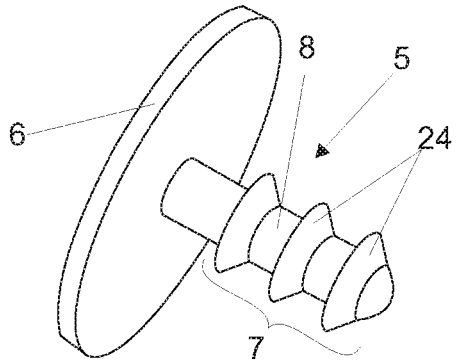
FIG. 16A shows an axonometric view of a clamping device according to seventh type.
Figure 16B:
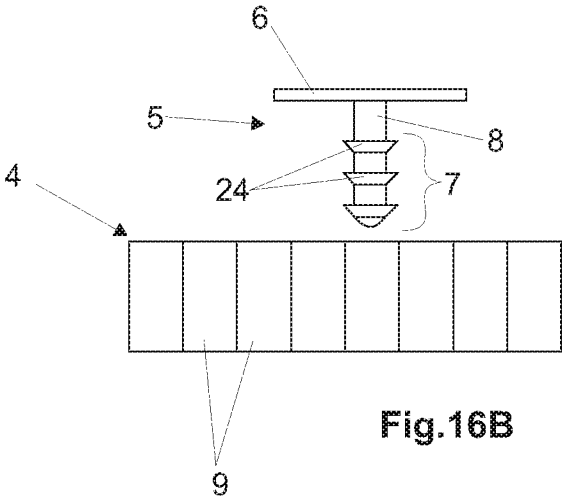
FIG. 16B shows a side view of the clamping device of FIG. 16A and a cellular energy-absorbing structure.
Figure 16C:
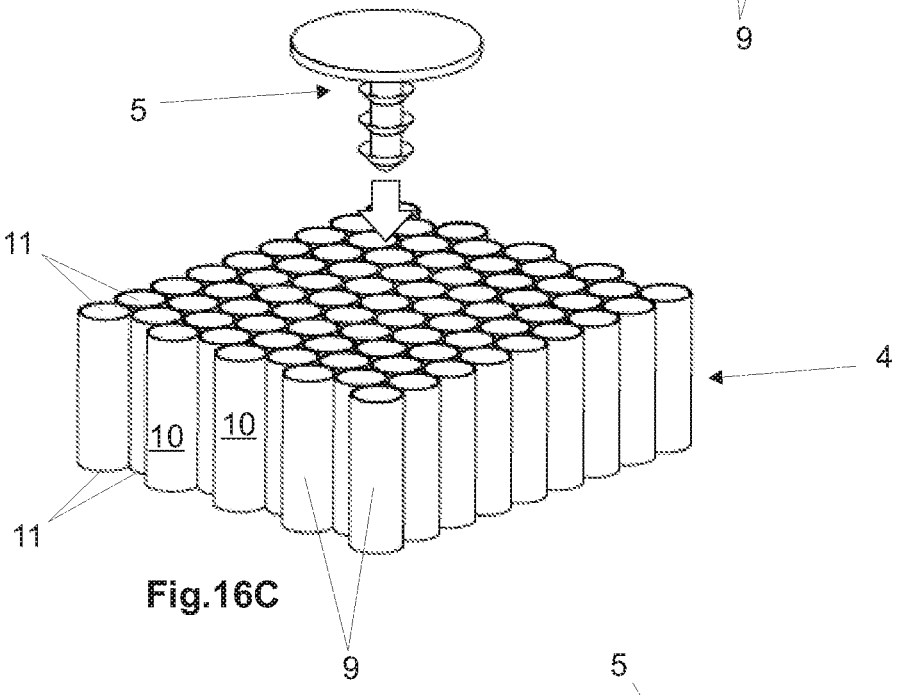
FIG. 16C shows an axonometric view of the clamping device of FIG. 16A and of a cellular energy-absorbing structure wherein the clamping device is not yet inserted in the cellular energy-absorbing structure.
Figure 16D:
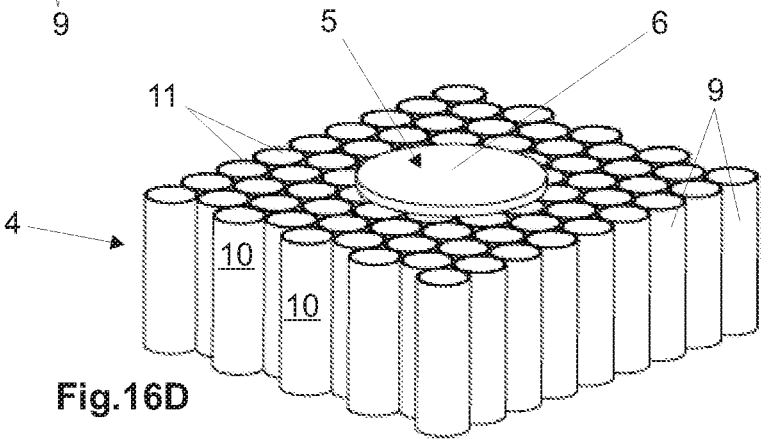
FIG. 16D shows an axonometric view of the clamping device of FIG. 16A and of a cellular energy-absorbing structure wherein the clamping device is inserted in the cellular energy-absorbing structure.

The clamping device 5 so conformed is shaped so to enter into one open-cell 9 of the cellular energy-absorbing structure 4, as shown in FIGS. 16B, 16C and 16D. Substantially, the collapsible body 8 is dimensioned so to enter in one single open-cell 9 of the cellular structure 4, without needing to enlarge the hole or performing other holes in the cellular structure 4. In this way, the integrity of the cellular structure 4 is guaranteed and its energy-absorbing performances assured at every point.

As shown in FIGS. 16B, 16C and 16D, the cellular structure 4 comprises an array of energy-absorbing open-cells 9. These open-cells 9 are connected to each other via their sidewalls 10.

The open-cells 9 are opened at their ends so that each open-cell 9 realizes a tube through which the air can flow.

All the features described for the embodiments of FIGS. 1, can be mixed to obtain further embodiments not represented but included in the present invention.

Furthermore, even if an embodiment employs a clamping devices 5 of one type, other clamping device 5 according to the present invention can be used instead of this.

Concluding, the invention so conceived is susceptible to many modifications and variations all of which fall within the scope of the inventive concept, furthermore all features can be substituted to technically equivalent alternatives. Practically, the quantities can be varied depending on the specific technical requirements. Finally, all features of previously described embodiments can be combined in any way, so to obtain other embodiments that are not herein described for reasons of practicality and clarity.

LEGEND OF REFERENCE SIGNS 1 helmet
2 shell
2A outer shell
2B inner shock absorbing liner
3 head receiving system
3A harness system
3B comfort system
4 cellular energy-absorbing structure
5 clamping device
6 base
7 counter-base
8 collapsible body
8A stretchable collapsible body
8B flexible collapsible body
8C protuberance
8D hollow body
9 open-cell
10 sidewalls
11 open base of the open-cell
12 solid portion of the lattice structure
13 open portion of the lattice structure
14 pocket
15 connecting means
16 tooth of the collapsible body
17 recess of the collapsible body
18 flexible pawl
19 geometric perturbation
20 dentition
21 mouth
22 exceeding portion
23 hole in the shell
24 gripper element
25 head of the wearer
26 low friction element
27 spacer
28 vent
29 axial bore
30 holed body
31 insert element
32 tapered portion
33 positioner
F force
Fn normal component of the force
Ft tangential component of the force
R relative rotation

The invention claimed is:

1. A helmet comprising:

a shell;

a head receiving system;

at least one cellular energy-absorbing structure comprising a plurality of interconnected open-cells configured to absorb energy by deforming during an impact on the shell;

at least one clamping device comprising a base and a counter-base connected to each other via a collapsible body, the collapsible body passes through one or more open-cells of the cellular energy-absorbing structure, and the base and the counter-base are opposite to each other with respect to the cellular energy-absorbing structure to connect the clamping device to the cellular energy-absorbing structure;

wherein the base or the counter-base of the clamping device comprises a low friction part, the low friction part is arranged over an outer surface of the base or counter-base facing the shell to enable the base or counter-base to slide over the shell, allowing a relative movement of the cellular energy-absorbing structure, together with the clamping device with respect to the shell.

2. The helmet according to claim 1, wherein the at least one cellular energy-absorbing structure comprises an array of energy-absorbing open-cells interconnected via their sidewalls.

3. The helmet according to claim 2, wherein each open-cell has an open base facing towards the shell and an opposite open base facing towards the head receiving system.

4. The helmet according to claim 1, wherein the at least one cellular energy-absorbing structure is a lattice structure comprising solid portions and open portions configured to form a network of interconnected open-cells.

5. The helmet according to claim 4, wherein the at least one cellular energy-absorbing structure is arranged so that one side of the structure faces towards the shell and an opposite side faces towards the head receiving system.

6. The helmet according to claim 1, wherein the at least one clamping device is configured so that the compressive force required to collapse the at least one clamping device along a direction is lower than or equal to that required to deform the open-cells of the at least one cellular energy-absorbing structure along the same direction.

7. The helmet according to claim 1, wherein the shell comprises only an outer hard shell and the low friction part is a spacer arranged between the at least one cellular energy-absorbing structure and the hard shell.

8. The helmet according to claim 1, wherein the shell comprises a rigid or semi-rigid outer shell and an inner shock absorbing liner connected to each other.

9. The helmet according to claim 8, wherein the inner shock absorbing liner comprises at least a pocket configured to retain and confine the cellular energy-absorbing structure.

10. The helmet according to claim 8, wherein the inner shock absorbing liner is made of a polymeric foam.

11. The helmet according to claim 1, wherein the head receiving system comprises a harness system or a comfort system.

12. The helmet according to claim 1, wherein the base or counter-base that does not comprise the low friction part is connected to the head receiving system through connecting means.

13. The helmet according to claim 12, wherein the connecting means comprise hook and look parts, an adhesive layer or snap-fit connector/s.

14. The helmet according to claim 1, wherein collapsible body is stretchable and is configured to appreciably and reversibly elongate with respect to its original length.

15. The helmet according to claim 1, wherein the collapsible body of the at least one clamping device is connected to the base and has an outer surface comprising a plurality of spaced teeth and spaced recesses, said counter-base comprises at least one flexible pawl shaped so to fit in one of said recesses, preferably the collapsible body is at least partially pleated or coiled, or comprises geometric perturbations to facilitate the collapse of the collapsible body.

16. The helmet according to claim 15, wherein the collapsible body is at least partially pleated or coiled, or comprises geometric perturbations to facilitate the collapse of the collapsible body.

17. The helmet according to claim 1, wherein the base comprises a protuberance having a dentition configured to cooperate with a mouth of a hollow body connected to the counter-base, said protuberance and said hollow body forming the collapsible body of the at least one clamping device.

18. The helmet according to claim 1, wherein the counter-base is configured to frictionally engage an inner sidewall of the at least one open-cell through a plurality of spaced flexible gripper elements protruding from the collapsible elongated body.

19. The helmet according to claim 1, wherein the shell comprises only an outer hard shell.

20. The helmet according to claim 1, wherein the shell comprises a rigid/semi-rigid outer shell and an inner shock absorbing liner connected to the rigid/semi-rigid outer shell.

21. The helmet according to claim 20, wherein the inner shock absorbing liner comprises at least a pocket configured to retain and confine the at least one cellular energy-absorbing structure and the at least one clamping device.

* * * * *